US005660489A

United States Patent [19]

Ishii et al.

[11] Patent Number: 5,660,489

[45] Date of Patent: Aug. 26, 1997

[54] SHEET-SUPPLYING ROLLER RECORDING DEVICE

[75] Inventors: Yasuyuki Ishii, Kawasaki; Toshimitsu Hirakue, Tokyo; Shigeru Yoshimura; Kenji Kurita, both of Yokohama; Masakazu Ozawa, Ebina; Masanori Morita, Murayama; Hiroaki Noaki, Chiba-ken; Eiichi Motai, Yokohama, all of Japan

[73] Assignee: Canon Kabushiki Kaisha, Tokyo, Japan

[21] Appl. No.: 683,129

[22] Filed: Jul. 18, 1996

Related U.S. Application Data

[63] Continuation of Ser. No. 242,640, May 13, 1994, abandoned.

[30] Foreign Application Priority Data

May 18, 1993 [JP] Japan ..... 5-116073

[51] Int. Cl.[6] ..... B41J 13/02

[52] U.S. Cl. ..... 400/641; 400/629; 271/109; 492/5

[58] Field of Search ..... 400/235, 624, 400/629, 641; 152/5, 9, 323, 324, 151, 155; 301/5.1; 156/DIG. 33; 193/37; 198/780, 843; 271/109, 119, 250, 251; 492/45, 56, 59

[56] References Cited

U.S. PATENT DOCUMENTS

| | | | |
|---|---|---|---|
| 493,002 | 7/1893 | Webster | 492/4 |
| 997,752 | 7/1911 | Clark | 152/5 |
| 2,005,626 | 6/1935 | Maranville | 301/5.1 |
| 3,042,179 | 7/1962 | Stern | 400/641 |
| 3,077,293 | 2/1963 | Watkins | 492/4 |
| 3,245,511 | 4/1966 | Macklin | 193/37 |
| 3,651,911 | 3/1972 | Kornylak | 193/37 |
| 3,734,491 | 5/1973 | Beery et al. | 193/37 |
| 3,957,147 | 5/1976 | Specht | 193/37 |
| 4,006,810 | 2/1977 | Kornylak | 193/37 |
| 4,448,554 | 5/1984 | Driemeyer | 400/641 |
| 4,693,696 | 9/1987 | Buck | 152/9 |
| 4,852,230 | 8/1989 | Yu | 193/37 |
| 5,035,037 | 7/1991 | Sprung | 492/4 |
| 5,284,333 | 2/1994 | Ishikawa | 271/251 |

FOREIGN PATENT DOCUMENTS

| | | | |
|---|---|---|---|
| 61-152471 | 7/1986 | Japan | 400/641 |
| 2-100938 | 4/1990 | Japan | 271/109 |

*Primary Examiner*—David Wiecking

*Attorney, Agent, or Firm*—Fitzpatrick, Cella, Harper & Scinto

[57] ABSTRACT

A roller comprises a rotary shaft, an outer peripheral wall member for defining an outer peripheral surface to be contacted with a sheet, and a support member for supporting the outer peripheral wall member so that the outer peripheral wall member surrounds the rotary shaft. The support member defines a space between the rotary shaft and the outer peripheral wall member and supports the outer peripheral wall member with maintaining a condition that the outer peripheral wall member is deformed to swell radially outwardly.

9 Claims, 5 Drawing Sheets

SHEET-SUPPLYING ROLLER RECORDING DEVICE

This application is a continuation of application Ser. No. 08/242,640 filed May 13,1994, now abandoned.

BACKGROUND OF THE INVENTION

1. Field of the Invention

The present invention relates to a roller used with a recording material supply apparatus to convey or supply a recording material.

2. Related Background Art

FIGS. 14 and 15 show an example of a supply roller portion of a conventional sheet supply apparatus comprising a rotary shaft 41, rubber roller holding members 42 secured to the rotary shaft, and belt-shaped sheet supply roller rubbers 43 fitted in recesses formed in the respective holding members. With this arrangement, the sheet supply roller rubbers 43 are contacted with a sheet S in parallel and uniformly so that the sheet can be conveyed to a recording position.

However, in this conventional arrangement, since surfaces of the sheet supply rollers which are contacted with the sheet are flat and the sheet supply rollers are solid, there is less margin for deformation of rubber and unevenness of contact pressure. As a result, the sheet is skew-fed during the recording operation, which results in the skew recording. If the skew-feed of the sheet is serious, the jamming of the sheet will occur. In order to eliminate the above-mentioned inconvenience, parts of the apparatus must be machined with higher accuracy and such parts must be assembled accurately, which results in the increase in the manufacturing cost.

SUMMARY OF THE INVENTION

An object of the present invention is to prevent the skew-feed of sheet by making a contact pressure between the sheet and a roller for conveying the sheet uniform.

To achieve the above object, according to the present invention, there is provided a roller for applying a conveying force to a sheet while contacting with the sheet, wherein a space is formed between an outer peripheral wall of the roller defining an outer peripheral surface for contacting with the sheet and an rotary shaft of the roller, and comprising a support member for supporting the outer peripheral wall in a condition that the outer peripheral wall was deformed to swell radially outwardly.

DETAILED DESCRIPTION OF THE PREFERRED EMBODIMENTS

According to an embodiment of the present invention in which a crown is formed on an outer peripheral surface of a roller as shown in FIGS. 1 to 5, a section of a hollow sheet supply roller rubber has a crown (mountain shape) protruded radially outwardly. The roller rubber shown in FIG. 1 has a hollow interior 13, an outer peripheral portion 14 constituting an outer peripheral surface of the roller, and side walls 15.

Figure 1:
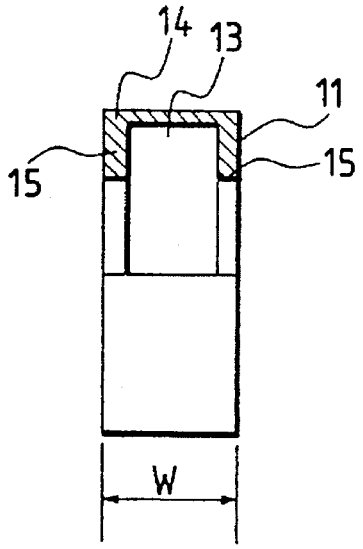
FIG. 1 is a plan view of a roller with partial section at its upper half.
Figure 2:
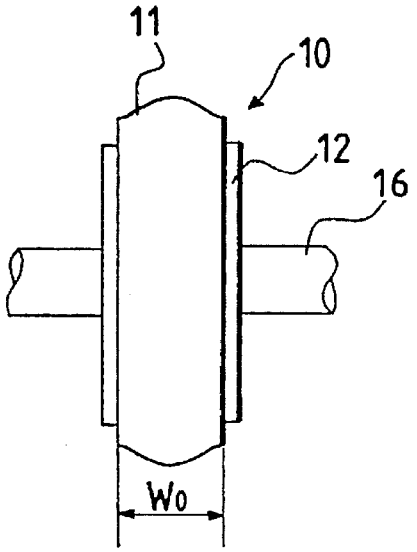
FIG. 2 is a plan view showing a condition that a roller rubber is assembled onto a holding member to form a roller.
Figure 3:
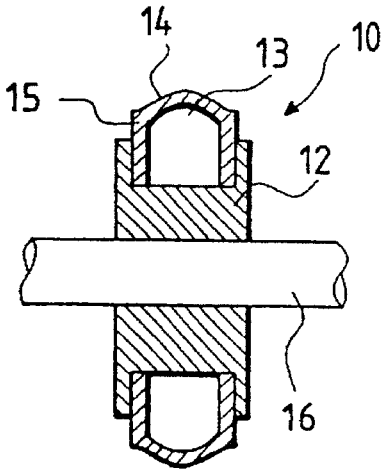
FIG. 3 is a sectional view of the roller of FIG. 3.
Figure 5:
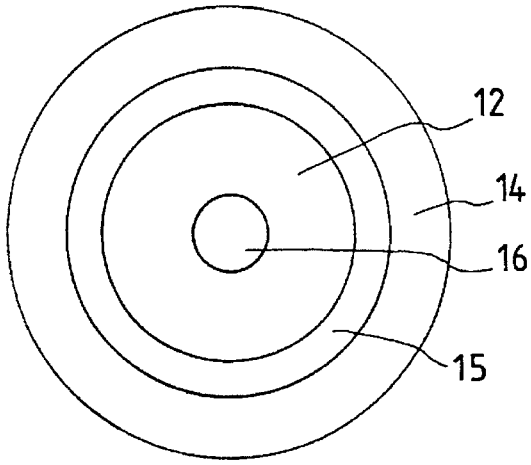
FIG. 5 is a side view of the roller.

FIG. 2 shows a roller 10 formed by fitting the roller rubber 11 onto a sheet supply roller rubber holding member 12. A width w of the original roller rubber 11 along a shaft 16 is greater than a width $w_0$ of a fitting portion of the holding member 12 on which the roller rubber is fitted, so that, when the roller rubber 11 is fitted on the holding member 12, as shown in FIG. 2, a central portion of the outer peripheral portion swells radially outwardly to increase a diameter of the roller rubber, thereby forming a crown on the outer peripheral surface of the roller rubber. FIG. 3 is a sectional view of the roller 10 in a plane passing through an axis of the shaft 16 and shows a condition that the central peripheral portion of the roller rubber swells to form the mountain shape or crown. The roller rubber 11 has the hollow interior 13 and each side wall 15 has a thickness greater than a thickness of the outer peripheral portion 14 so that the side walls 15 are not deformed, thereby facilitating the formation of the crown. FIG. 5 is a side view of the roller 10.

By using the sheet supply roller rubber having such a configuration, it is possible to prevent the offset contact between the roller and a sheet and the unevenness of a sheet supplying pressure, thereby stabilizing the sheet supplying operation.

Figure 4:
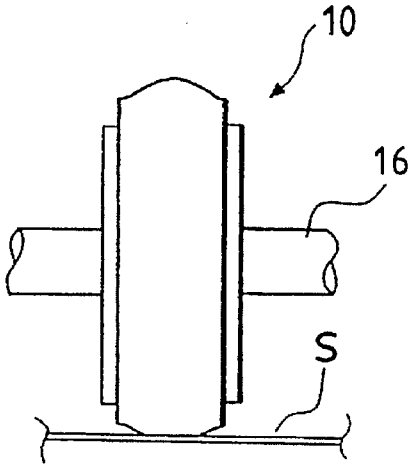
FIG. 4 is a view showing a condition that the roller is contacted with a sheet.

FIG. 4 shows a condition that the sheet supply roller 10 according to the present invention is contacted with a paper sheet S so that a portion of the crown is flatened to feed the sheet in a direction perpendicular to the shaft.

Next, an embodiment wherein the present invention is applied to a pick-up of a printer will be explained.

Figure 6:
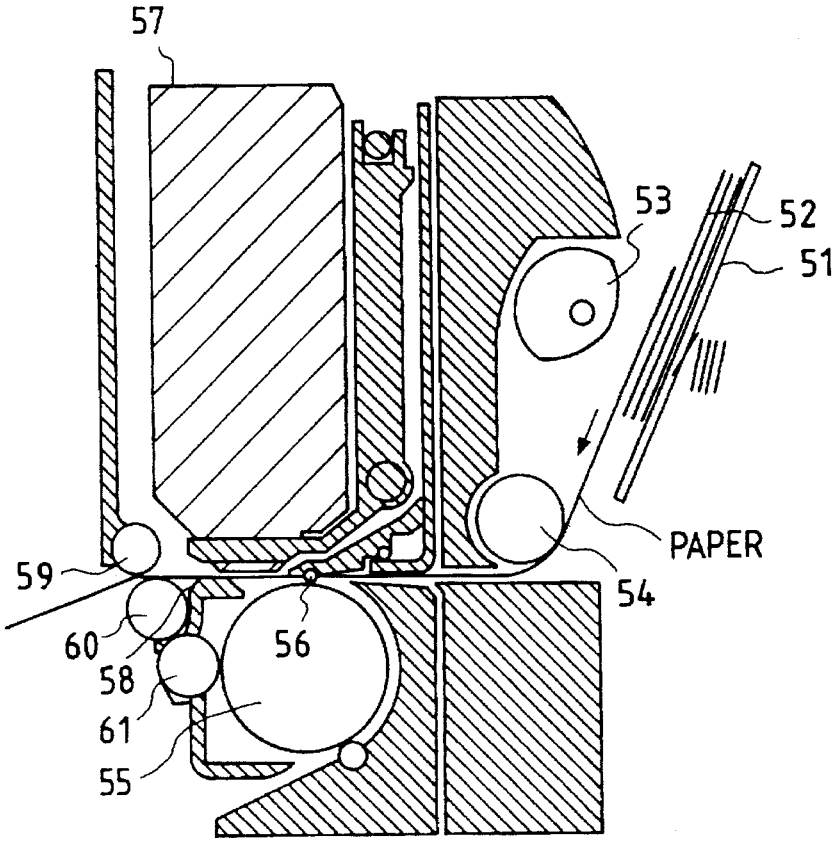
FIG. 6 is a sectional view showing the entire construction of a printer.

FIG. 6 shows the entire construction of the printer. In FIG. 6, a sheet stack 52 is rested on a stacking tray 51, and a pick-up roller 53 is rotated in an anti-clockwise direction and is contacted with an uppermost sheet in the sheet stack to feed out the sheet. Convey rollers 54, 55 serve to convey the sheet fed out by the pick-up roller 53 in a downstream direction. A roller 56 for urging the sheet against the convey roller 55 is biased toward the convey roller 55 by means of a spring (not shown). A recording head 57 serves to record an image on the sheet conveyed by the convey rollers 54, 55. In the illustrated embodiment, the recording head is an ink jet head for discharging ink from nozzle(s) toward the surface of the sheet, and particularly, the head is of ink jet recording type in which the ink is heated until a bubble is formed in the ink by means of a heat generating element disposed in the nozzle so that the ink is discharged from the nozzle due to the growth of the bubble.

A guide member 58 serves to support the sheet in such a manner that a distance between the recording head 57 and the sheet is maintained constant. The sheet on which the image was recorded is discharged out of the printer by a pair of discharge rollers 59, 60. A transmission roller 61 is contacted with both the convey roller 55 and the discharge roller 60 to transmit a rotational driving force of the convey roller 55 to the discharge roller 60.

FIGS. 7 to 11 show the pick-up roller 53 of FIG. 6.

Figure 7:
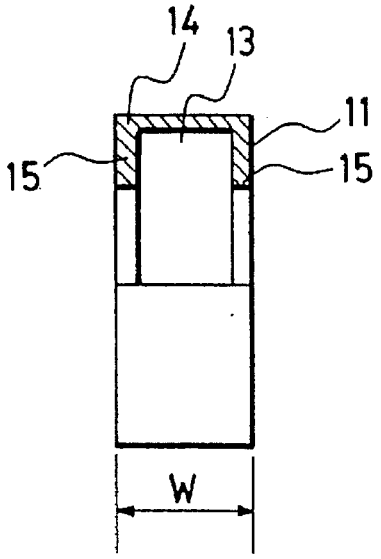
FIG. 7 is a plan view of another roller with partial section at its upper half.
Figure 8:
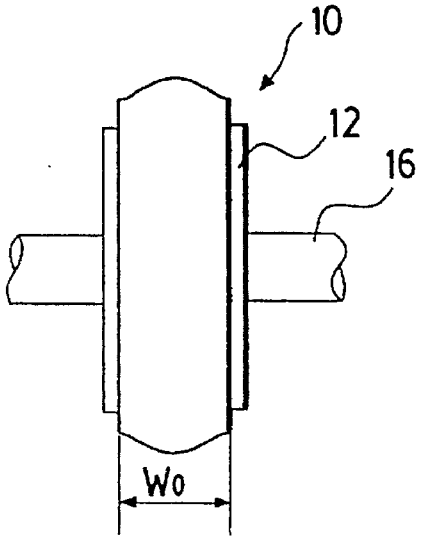
FIG. 8 is a plan view showing a condition that a roller rubber is assembled onto a holding member to form a roller.

FIG. 7 shows a roller rubber 11 having a hollow interior 13, an outer peripheral portion 14, and side walls 15. FIG. 8 shows the pick-up roller 10 formed by fitting the roller rubber 11 onto a sheet supply roller rubber holding member 12. Also in this case, since $w_0<w$, a central portion of the roller rubber 11 swells radially outwardly to increase a diameter of the roller.

Figure 9:
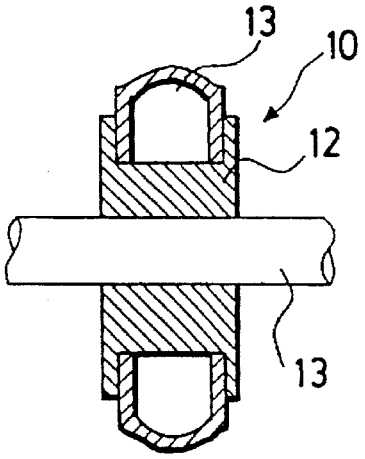
FIG. 9 is a sectional view of the roller of FIG. 7.
Figure 10:
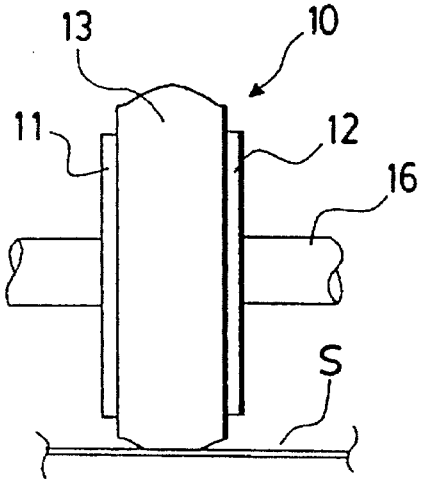
FIG. 10 is a view showing a condition that the roller is contacted with a sheet.
Figure 11:
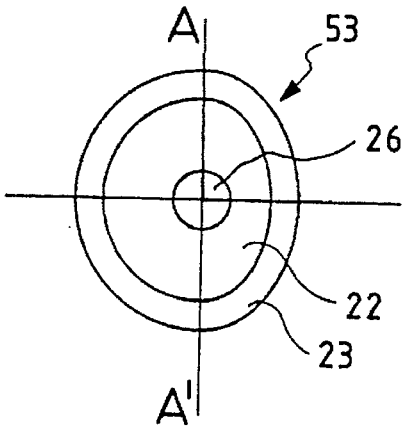
FIG. 11 is a side view of the roller.

FIG. 11 is a side view of the pick-up roller 10, and FIG. 9 is a sectional view taken along the line A–A' in FIG. 11. FIG. 10 shows a condition that the sheet S is being conveyed by the pick-up roller. In this condition, the crown of the roller rubber is abutted against the sheet to be deformed in a flat condition. Due to this deformation, the face-contact is generated between the sheet and the pick-up roller 10 and the contact pressure becomes uniform through the entire contact area. Accordingly, during the separation of the sheet from the sheet stack rested on the stacking tray 51, it is possible to prevent the offset contact between the sheet and the roller and to prevent skew-separation of the sheet, thereby stabilizing the sheet separation.

Figure 12:
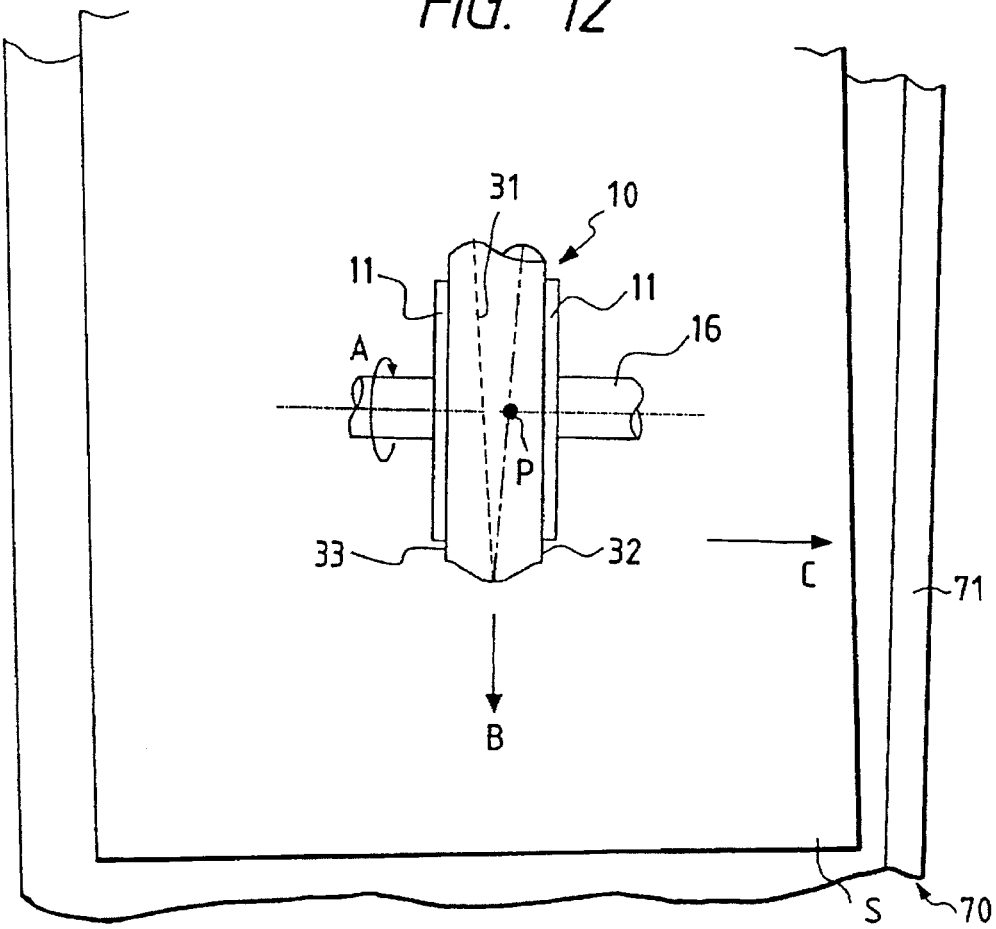
FIG. 12 is an explanatory view for explaining a roller in which a line showing a top or crown of the roller is spiral.
Figure 13:
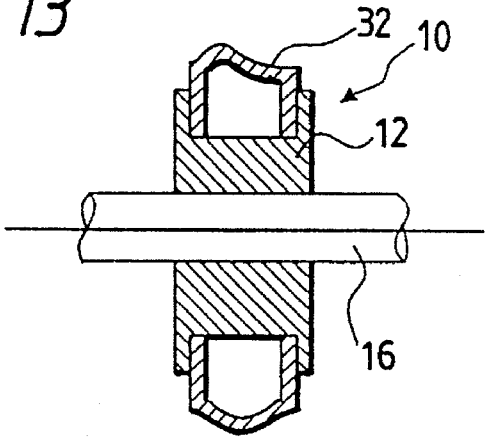
FIG. 13 is a sectional view of the roller of FIG. 12.
Figure 14:
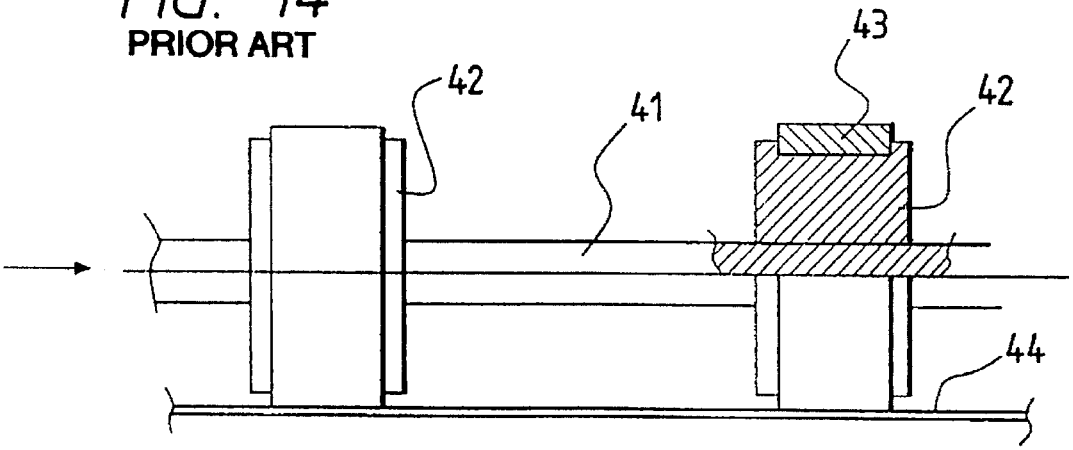
FIG. 14 PRIOR ART
FIG. 14 is a plan view, partially in section, of a conventional roller assembly.
Figure 15:
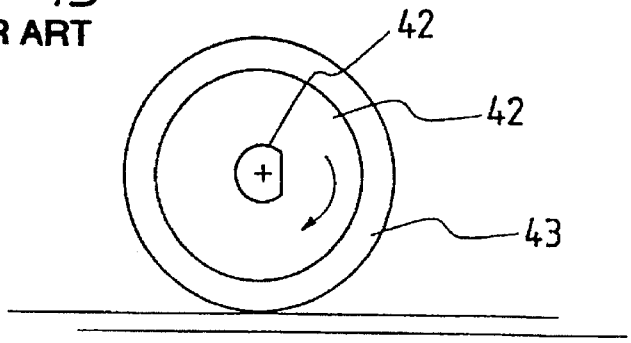
FIG. 15 PRIOR ART
FIG. 15 is a side view of a roller of the assembly of FIG. 14.

FIGS. 12 and 13 show an embodiment in which a line 31 showing a crown on the outer peripheral portion of a roller is spiral directing from one side 32 toward the other side 33 of the rubber roller 10 during one revolution of the roller. With this arrangement, when the roller is rotated, there arises a component of force for shifting the sheet toward a longitudinal direction of a roller shaft 16. Such spiral crown can be formed by making a thickness of a portion of the outer peripheral surface of the roller rubber on which the crown is to be formed thinner than the other portions of the outer peripheral surface so that the portion of the outer peripheral surface can swell due to the compression force generated by the relation $w_0<w$.

FIG. 12 also shows a plan view of a sheet stacking tray 70 having a side guide 71 for regulating and guiding a side edge of the sheet. When the roller 10 is rotated in a direction shown by the arrow A, the sheet S is fed toward a direction shown by the arrow B. As the roller 10 is rotated, a contact point P between the sheet S and the spiral line 31 is shifted toward a direction shown by the arrow C along the shaft 16. Thus, the component of force directing to the direction C acts on the sheet S, with the result that the sheet S is urged against the side guide 71 while being shifted to the direction B, thereby correcting the skew-feed of the sheet.

The above-mentioned roller arrangement may be provided in a sheet convey path, as well as the sheet supply roller.

According to the present invention, the following advantages can be obtained:

(1) The sheet supplying operation can be stabilized;

(2) The skew-feed of the sheet can be corrected automatically;

(3) Without any additional means, the above advantages (1) and (2) can be achieved;

(4) Thus, the cost-down can be achieved; and (5) When the materials to be used are limited, various contact pressures can be obtained by appropriately selecting the thickness of rubber and the relation $w_0<w$.

What is claimed is:

1. An image forming apparatus comprising:

a roller for supplying a sheet;

image forming means for forming an image on the sheet supplied by said roller; and said roller comprising a rotary shaft, an outer peripheral portion for defining an outer peripheral surface to be contacted with the sheet, and a holding member for supporting said outer peripheral portion so that said outer peripheral portion surrounds said rotary shaft, said holding member defining a space between said rotary shaft and said outer peripheral portion and supporting said outer peripheral portion so that a distance between both sides of said outer peripheral portion is shortened to swell said outer peripheral portion.

2. An image forming apparatus according to claim 1, wherein said image forming means has an ink jet head.

3. An image forming apparatus according to claim 2, wherein said ink jet head forms the image on the sheet by discharging an ink droplet by utilizing thermal energy.

4. A roller comprising:

a rotary shaft;

an outer peripheral portion for defining an outer peripheral surface to be contacted with a sheet;

side walls extending from said outer peripheral portion and having a cross-section with a thickness larger than a thickness of a cross-section of said outer peripheral portion; and a holding member for supporting said outer peripheral portion via said side walls so that said outer peripheral portion surrounds said rotary shaft;

wherein said holding member defines a space between said rotary shaft and said outer peripheral portion, and supports said outer peripheral portion so that between both sides of said outer peripheral portion is said side walls are urged together to swell an outer circumference of said outer peripheral portion.

5. A roller according to claim 4, wherein said side walls are configured to extend from said outer peripheral portion toward said rotary shaft.

6. A roller according to claim 5, wherein said side walls are ring-shaped.

7. A roller according to claim 6, wherein said holding member supports said side walls from both sides thereof to reduce a distance between said side walls.

8. A roller according to claim 6, wherein the deformed outer peripheral portion has a spiral ridge line.

9. A sheet supply apparatus comprising:

a guide surface for guiding a surface of a sheet;

regulating means for regulating a side edge of the sheet; and a roller for supplying the sheet along said guide surface, said roller comprising a rotary shaft, an outer peripheral portion for defining an outer peripheral surface to be contacted with the sheet, and a holding member for supporting said outer peripheral portion so that said outer peripheral portion surrounds said rotary shaft, said holding member defining a space between said rotary shaft and said outer peripheral portion and supporting said outer peripheral portion so that a distance between both sides of said outer peripheral portion is shortened to swell said outer peripheral portion.

* * * * *

UNITED STATES PATENT AND TRADEMARK OFFICE

CERTIFICATE OF CORRECTION

PATENT NO. : 5,660,489
DATED : August 26, 1997
INVENTOR(S) : Yasuyuki ISHII, et al.

It is certified that error appears in the above-identified patent and that said Letters Patent is hereby corrected as shown below:

On the title page:

Item [54]: after "ROLLER", insert --AND--.

Column 1, line 1: after "ROLLER", insert --AND--;
Line 46, delete "an" and insert therefor --a--.

Column 2, line 49, delete "flatened" and insert therefor --flattened--.

Column 4, line 37: delete "between";
Line 38, delete "both sides of said outer peripheral portion is".

Signed and Sealed this

Twenty-fourth Day of March, 1998

Bruce Lehman

*Attest:*

BRUCE LEHMAN

*Attesting Officer*

*Commissioner of Patents and Trademarks*